US005697659A

United States Patent [19]

Calagui

[11] Patent Number: 5,697,659

[45] Date of Patent: Dec. 16, 1997

[54] EATING UTENSIL

[76] Inventor: Juanito Calagui, P.O. Box 325, Passaic, N.J. 07055

[21] Appl. No.: 645,338

[22] Filed: May 13, 1996

[51] Int. Cl.[6] ..... A47G 21/10; A47J 43/28

[52] U.S. Cl. ..... 294/99.2; 294/33

[58] Field of Search ..... 294/1.1, 5.5, 8.5, 294/16, 33, 99.2, 103.1; 30/142, 150; D7/642, 645

[56] References Cited

U.S. PATENT DOCUMENTS

| | | | |
|---|---|---|---|
| 90,319 | 5/1869 | Somers | 294/99.2 |
| D. 343,096 | 1/1994 | Lachapelle | D7/642 |
| 874,547 | 12/1907 | Shaw | 294/99.2 |
| 3,304,111 | 2/1967 | Kauh et al. | D7/642 |
| 3,937,510 | 2/1976 | Lew | 294/99.2 |
| 4,576,408 | 3/1986 | Maneki | D7/642 |
| 4,768,288 | 9/1988 | Culbertson | 294/99.2 |
| 4,973,095 | 11/1990 | Kunihisa | 294/33 |
| 5,486,029 | 1/1996 | Kobayashi | 294/33 |

*Primary Examiner*—Dean Kramer
*Attorney, Agent, or Firm*—M. K. Silverman

[57] ABSTRACT

An eating utensil in the nature of an improved chop stick system includes a first elongate member having a ratio of length to average cross-section in the range of about 20:1 to about 60:1. The utensil also includes a second elongate member of substantially like geometry to the first member. The eating utensil further includes a spring like element for providing an outward angular bias, the element including two opposing arms, one of each of the arms secured to opposing lateral surfaces of the first and second members, the lateral surfaces being near respective opposing ends of each of the elongate members. The eating utensil yet further includes a guide element for limiting the angular extent in plane of travel of one of the members relative to the other member.

5 Claims, 2 Drawing Sheets

14

EATING UTENSIL

BACKGROUND OF THE INVENTION

The present invention relates to an eating utensil and, more particularly, relates to an improvement in a Chinese chop stick system.

As is well known, chop sticks are elongated elements having a length of about ten inches and a diameter of ¼ to ⅓ inch which have been used for thousands of years in the Orient as a primary utensil used to grasp various types and consistencies of solid foods in order to effect the eating thereof. As such, the chop stick has served as the oriental equivalent of the western fork for dozens of centuries.

In modern times, many westerners have attempted to master the use of chop sticks so that, on certain occasions, when eating in a Chinese or Japanese restaurant, they are able to eat such food in the same manner as it has historically been eaten in the Orient. However, proficiency in the use of chop sticks has proven most difficult for many westerners to acquire. Also, many people in the Orient do not feel that the historical or classical chop stick pair is today a viable equivalent of the western fork, given the vast range of types of solid foods which, in modem times, have been introduced from the west.

Accordingly, a need has arisen for an improvement of the traditional chop stick system on a basis that would not be culturally or otherwise offensive to people of the Orient and which, on the other hand, would, for westerners, be easier to utilize than the traditional chop stick system. It is as a response to the above set forth needs that the present invention is directed.

To the knowledge of the inventor, there does not exist any prior art which is relevant to the within set forth improved chop stick system.

SUMMARY OF THE INVENTION

An eating utensil, in the nature of an improved chop stick system, includes a first elongate member having a ratio of length to average cross-section thereof in the range of 20:1 to 60:1. The improved utensil further includes a second elongate member of substantially like geometry to said first member. The inventive member further includes means for providing an outward angular bias, said means including two opposing arms, one of each of said arms secured to opposing lateral surfaces of said first and second members. Said lateral surfaces are proximal to respective opposing ends of each of said elongate members. The improved eating utensil yet further includes guide means for limiting the angular extent and plane of travel of one of said members relative to the other.

It is an object of the present invention to provide an improvement of the traditional chop stick.

It is another object to provide an eating utensil which may be employed as a substitute for the historical oriental chop stick.

It is a further object to provide an improved chop stick system.

It is a yet further object to provide an eating utensil which may be utilized as a substitute for the western fork.

The above and yet other objects of the present invention will become apparent from the hereinafter set forth Brief Description of the Drawings, Detailed Description of the Invention and Claims appended herewith.

DETAILED DESCRIPTION OF THE INVENTION

Figure 1:
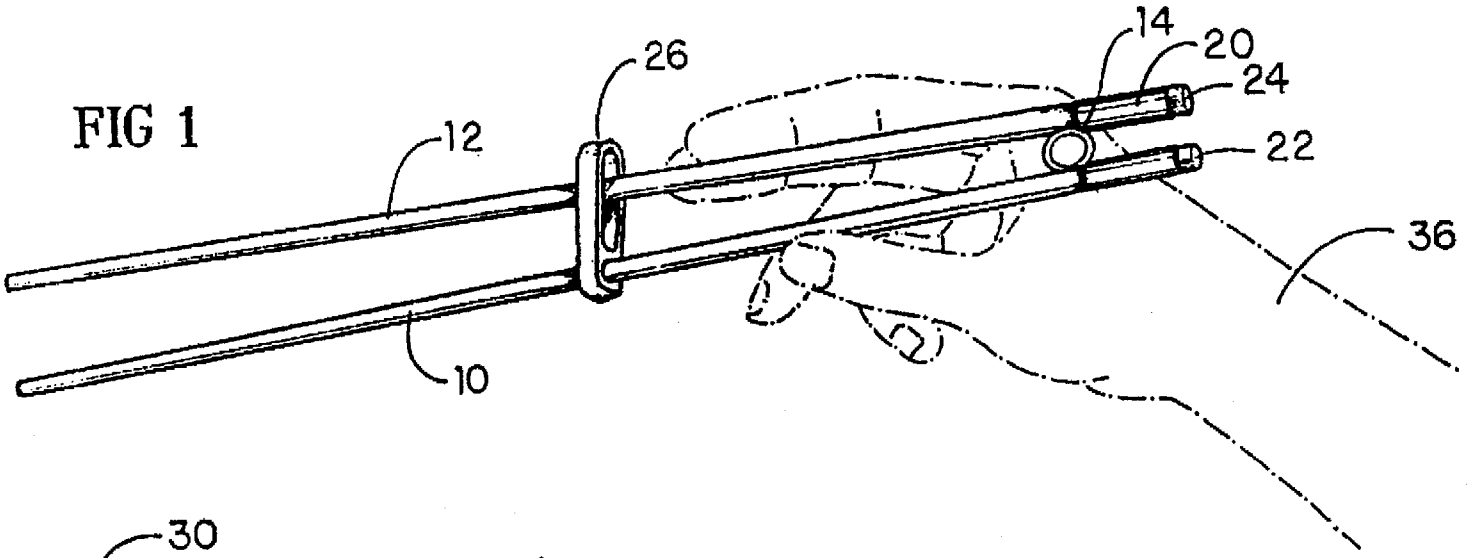
FIG. 1 is a perspective view of the inventive eating utensil in an open position.

With reference to the perspective operational view of FIG. 1, the instant inventive eating utensil may be seen to include a first elongate member 10 having a length of about ten inches and having a cross-sectional diameter of about one-quarter inch. More particularly, it has been found that the ratio of the length to the average cross section of the elongate member 10 should fall in a range of about 20:1 to about 60:1. It is also noted that the cross-section of member 10 gradually increases from the left to right end thereof.

Further shown in FIG. 1 is a second elongate member 12 having a geometry which is substantially the same as that of said first member. In a preferred embodiment, said first and second elongate members are identical.

Figure 4:
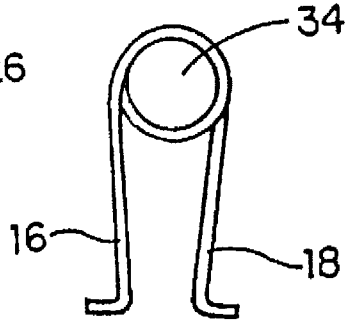
FIG. 4 is a front plan view of a spring means used therewith.
Figure 5:
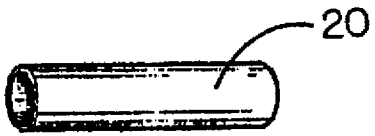
FIG. 5 is a perspective view of a sleeve usable with a spring arm of said spring means.

Also shown in FIG. 1 is a spiral loop spring 14 which comprises a means for providing an outward angular bias of said members 10 and 12 relative to each other. More particularly, as may be seen with reference to the front plan view of FIG. 4, said outward angular bias-providing means of spring 14 includes two opposing arms 16 and 18 in which one of each of said arms is secured to opposing lateral surfaces of said first and second members 10 and 12 through the use of hollow cylindrical securing means 20 shown in FIGS. 1 and 5. It is to be appreciated that such securing means are not limited to the use of cord, wire or the like but, rather, preferable comprise integral levels of the type shown in FIG. 5, formed of lightweight metal, which are simply slipped over said arms 16 and 18 of the spring 14 and over the lateral surfaces of the members 10 and 12 which are proximal to respective opposing ends 22 and 24 of the elongate member 10 and 12 respectively. It should be noted that the outward angular bias of spring 14 constitutes one part of the invention which defines a plane of exclusive angular travel of elongate member 10 relative to elongate member 12. It is to be appreciated that outward angular bias means, other than that of spiral loop spring 24, may be used in substitution of the spiral loop spring shown in FIGS. 1, 2 and 4.

Further shown in FIG. 1 is guide means 26 (see also FIG. 3) which operates to limit the angular extent of travel of member 10 relative to member 12 and, as well, acts, in combination with the arm 16 and 18 of spiral loop spring 14, to define the exclusive angular plane of travel of member 10 relative to member 12 that can occur.

Figure 3:
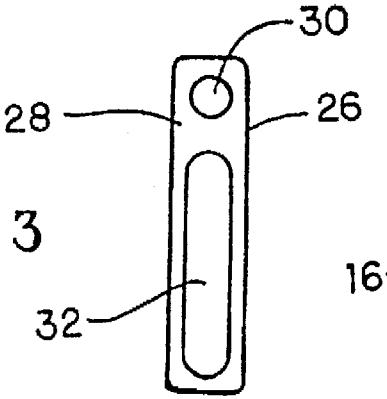
FIG. 3 is a front plant view of a guide means used with the present invention.

With reference to FIGS. 1 and 3 it is to be further appreciated that guide means 26 is formed of a plane-defining, i.e., the plane of FIG. 3, integral body 28 having therein a hole 30 transverse to the plane of said body which is proportioned to engage the gradually increasing cross-section of said first elongate member 10 (see FIG. 1) at about the middle of the length thereof.

As may be further noted in FIG. 3, said guide means 26 further includes a slot 32 which is proportioned to accommodate said elongate member 12 over an angular range of travel in a direction transverse to the plane of said body 28 of about plus three degrees to about minus three degrees relative to a respective position of said members in which said members are parallel to each other. Accordingly, it is noted that the view of FIG. 1 shows the inventive eating utensil in a substantially open position in which the second elongate member 12 is substantially open relative to the first member 10 and, therefore, is near to the plus three degree position relative to the zero angulation between members 10 and 12 which exists when the two members are parallel to each other, this occurring when all points on each of the members are separated from each other by a dimension corresponding to the diameter of center portion 34 of the spiral spring 14.

Figure 2:
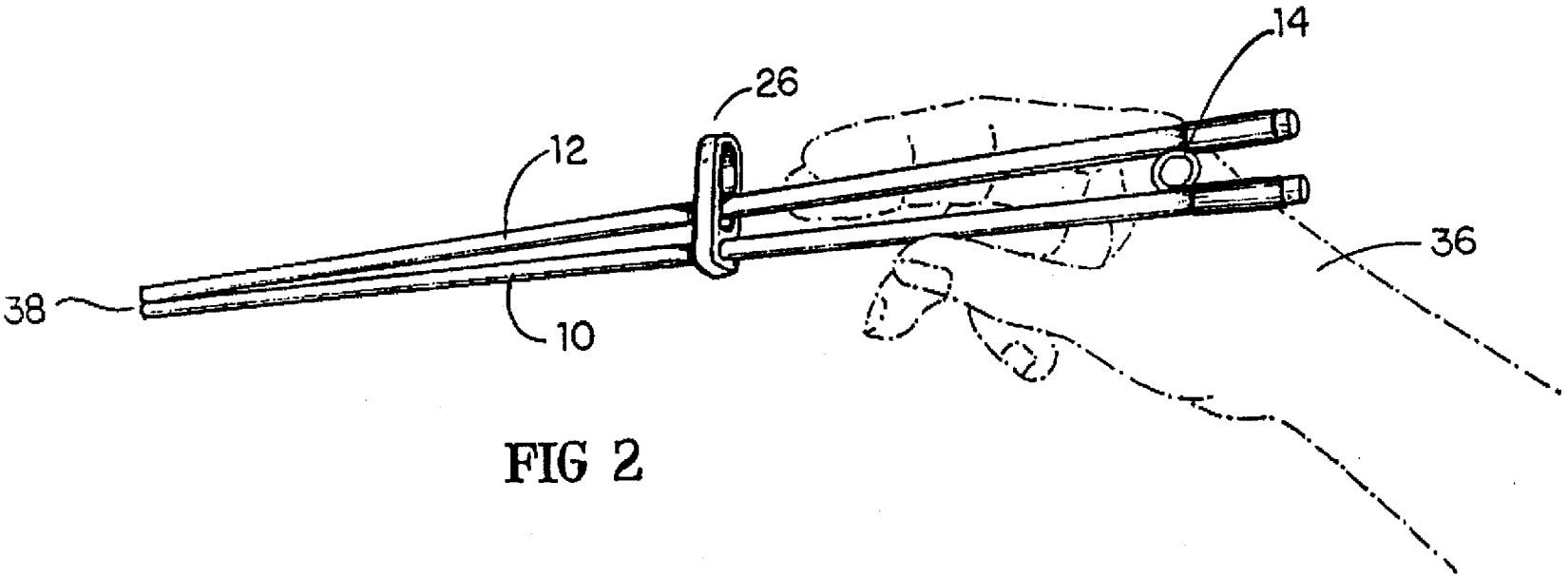
FIG. 2 is a perspective view thereof showing its use in a closed position.

With reference to the view of FIG. 2, the opposite condition is shown, that is, the minus three degrees position of the members 10 and 12 relative to each other which exists when a hand 36 of a user presses the two members together, thereby overcoming the normal outward angular bias of spring 14 so that ends 38 of the member 10 and 12 are touching.

It is, accordingly, to be understood that the co-action of spring 14 and guide means 26 is such that second member 12 can travel only within a single explosive plane of angular motion relative to first member 10. The operational consequence of this system is that the use of chop sticks is much easier and the control thereof is vastly improved. For example, much smaller piece of solid foods can be grasped with the inventive chop stick system and more conventional sized solid, and semi-solid, food is much easier to engage with the present system.

Further, the inventor has found that the addition of spring 14 and guide means 26 to conventional chop sticks is not offensive to traditional values of people of the Orient. With regard to the length of the elongate elements 10 and 12, a preferred length thereof has been found to be about ten inches, although the range thereof may extend from about five to about 15 inches. Also, the elongate elements may be made out of either wood or thermoplastic materials. Further, the cross-section thereof may be either circular, square, polygonal or combinations thereof.

Accordingly, while there has been shown and described the preferred embodiment of the present invention it is to be understood that the invention may be embodied otherwise than is herein specifically shown and described and that, within said embodiment, certain changes may be made in the form and arrangements of the parts without departing from the underlying idea or principles of this invention within the scope of the Claims appended herewith.

Having thus described my invention what I claim as new, useful and non-obvious and, accordingly, secure by Letters Patent of the United States is:

1. An eating utensil, comprising:

(a) a first elongate member of gradually increasing cross-section having a ratio of length to average cross-section thereof in a range of about 20:1 to about 60:1, in which the length of said member comprises a range of about five to about fifteen inches;

(b) a second elongate member of substantially like geometry to said first member;

(c) means for providing an outward angular bias, said means including two opposing arms, one each of said arms secured to opposing lateral surfaces of said first and second members, said lateral surfaces proximal to respective opposing ends of each of said elongate members; and (d) guide means for limiting the angular extent, and plane of travel, of one of said elongate members relative to the other, said guide means comprising a plane-defining integral body having therein a hole in said plane of said body, said hole proportioned to accommodate said first member and further having a slot in said plane of said body proportioned to accommodate said second member over an angular range of motion transverse to said plane of said integral body.

2. The utensil as recited in claim 1, in which said bias-providing means comprises a spiral loop spring.

3. The utensil as recited in claim 1, in which longitudinal length of each of said members comprises about ten inches.

4. The utensil as recited in claim 1, in which said ratio of length to average cross section thereof comprises a ratio of about 40:1.

5. The guide means as recited in claim 1, in which said angular range of motion of said first elongate member relative to said second member comprises a range of about minus three degrees to about plus three degrees relative to respective positions of said members in which said members are parallel to each other.

* * * * *